US006738016B2

(12) United States Patent
Li et al.

(10) Patent No.: US 6,738,016 B2
(45) Date of Patent: May 18, 2004

(54) METHOD FOR IMPROVING SMART ANTENNA ARRAY COVERAGE

(75) Inventors: Feng Li, Beijing (CN); Xiaolong Ran, Beijing (CN)

(73) Assignee: China Academy of Telecommunications Technology, Beijing (CN)

( * ) Notice: Subject to any disclaimer, the term of this patent is extended or adjusted under 35 U.S.C. 154(b) by 0 days.

(21) Appl. No.: 10/255,337

(22) Filed: Sep. 25, 2002

(65) Prior Publication Data

US 2003/0058165 A1 Mar. 27, 2003

Related U.S. Application Data

(63) Continuation of application No. PCT/CN01/00017, filed on Jan. 12, 2001.

(30) Foreign Application Priority Data

Mar. 27, 2000 (CN) ..... 00103547 A

(51) Int. Cl.[7] ..... H01Q 3/00
(52) U.S. Cl. ..... 342/360
(58) Field of Search ..... 342/360, 367, 342/372, 378

(56) References Cited

U.S. PATENT DOCUMENTS

| | | | | |
|---|---|---|---|---|
| 5,565,873 | A | | 10/1996 | Dean |
| 5,920,286 | A | | 7/1999 | Mohebbi |
| 5,924,020 | A | | 7/1999 | Forssen et al. |
| 6,101,399 | A | | 8/2000 | Raleigh et al. |
| 6,239,744 | B1 | * | 5/2001 | Singer et al. ..... 342/359 |
| 6,400,318 | B1 | * | 6/2002 | Kasami et al. ..... 342/383 |
| 6,559,798 | B1 | * | 5/2003 | Marumoto et al. ..... 342/372 |

FOREIGN PATENT DOCUMENTS

| | | |
|---|---|---|
| AU | 199947444 B2 | 3/2000 |
| CN | 2293907 Y | 10/1998 |
| EP | 0984507 A2 | 3/2000 |
| WO | WO 99/12232 | 3/1999 |
| WO | WO 00/26988 | 5/2000 |

OTHER PUBLICATIONS

Internationl Search Report corresponding to International Application No. PCT/CN01/00017 dated May 24, 2001.

* cited by examiner

*Primary Examiner*—Dao Phan
(74) *Attorney, Agent, or Firm*—Alston & Bird LLP

(57) ABSTRACT

The invention relates to a method for improving smart antenna array coverage. Arbitrary beam forming of an antenna array can be implemented by adjusting n antenna units beam forming parameter W(n), based on difference of size and shape between coverage required in engineering design and actually realized coverage. The method includes: setting an accuracy of W(n), i.e. an adjusting step length, setting a set of initial values $W_0(n)$, an initial value of mean-square error $\epsilon_0$, setting counting variable, setting threshold of ending adjustment M and maximum emission power of an antenna unit T(n). With the settings, a loop for W(n) adjustment is executed. A step-by-step approximation method is deployed for adjusting antenna radiation parameters, based on the minimum mean-square error criterion. Finally, an actual coverage of an antenna array approximates to the required coverage, under local optimization condition.

19 Claims, 6 Drawing Sheets

METHOD FOR IMPROVING SMART ANTENNA ARRAY COVERAGE

CROSS-REFERENCE TO RELATED APPLICATIONS

This is a continuation of PCT/CN01/00017, filed Jan. 12, 2001, which is incorporated herein by reference in its entirety. The present application also claims the benefit of Chinese Patent Application No. 00103547.9, filed Mar. 27, 2000.

FIELD OF THE INVENTION

The present invention generally relates to a smart antenna array technology used in a cellular mobile communication system, and more particularly to a method that can improve smart antenna array coverage.

BACKGROUND OF THE INVENTION

In a cellular mobile communication system using a smart antenna array, the smart antenna array is built into a radio base station, in general. The smart antenna array must use two kinds of beam forming for transmitting and receiving signals: one kind is the fixed beam forming, while another is the dynamic beam forming. The fixed beam forming, such as omnidirectional beam forming, strip beam forming or sector beam forming, is mainly used for transmitting omnidirectional information, such as broadcasting, paging etc. The dynamic beam forming is mainly used for tracing subscribers and transfers a subscriber's data and signaling information, etc. to a specific user.

FIG. 1 shows a cell distributing diagram of a cellular mobile communication network. Coverage is the first issue to be considered when designing a cellular mobile communication system. In general, a smart antenna array of a wireless base station is located at the center of a cell, as shown by the black dots 11 in FIG. 1. Most cells have normal circle coverage, as shown by 12. Some cells have non-symmetric circular coverage, as shown by 13, and "strip" coverage, as shown by 14. The normal circle coverage 12, non-symmetric circular coverage 13 and strip coverage 14 are overlapped for non-gap coverage.

It is well known that a power radiation diagram of an antenna array is determined by the parameters such as: geometrical arrangement shape for antenna units of the antenna array, characteristics of each antenna unit, phase and amplitude of radiation level of each antenna unit, etc. When designing an antenna array, in order to make the design one that can be commonly used, the design is taken under a relatively ideal environment, which includes free space, equipment works normally, etc. When a designed antenna array is put in practical use, the real power coverage of the antenna array will certainly be changed because of different installing locations and positions, different landforms and land surface features, different building heights and different arrangements of antenna units, etc.

FIG. 2 (part of FIG. 1) shows a difference of an expected coverage 21 (normal circle) and a real or actual coverage 22, as such real coverage is caused because of different landforms and land surface features, etc. The real coverage can be measured at a cell's site. It is possible that every cell has this kind of difference, so unless adjustments are made at a cell's site, real coverage of a mobile communication network may be very bad. Besides, there is a need to reconfigure an antenna array when an individual antenna unit of the antenna array does not work normally or coverage requirement has been changed, at this time the coverage of the antenna array must be adjusted in real time.

The principle of the adjustment is: based on fixed beam forming for omnidirectional coverage of a cell, a smart antenna array implements dynamic beam forming (dynamic directional radiation beam) for an individual subscriber.

For formula (1): A(ϕ) represents the shape parameter of the expected beam forming, (i.e., the needed coverage), wherein 4) represents polar coordinate angle of an observing point, and A(ϕ) is the radiation strength in the ϕ direction, with same distance.

$$\text{Shape Parameter Of The Expected Beam Forming}=A(\phi) \tag{1}$$

Suppose there are N antennas for a smart antenna array, wherein any antenna n has a position parameter D(n), a beam forming parameter W(n) and an emission power P in angle ϕ direction, then the real coverage is represented by formula (2):

$$P(\phi)=\left|\sum_{n=1}^{N} f(\phi, D(n))\times W(n)\right|^2 \tag{2}$$

Wherein the form of the function f(ϕ,D(n)) is related with the type of a smart antenna array.

In a land mobile communication system, taking into account two dimensional coverage on a plane is enough, in general. When dividing antennas in an arrangement, there are linear arrays and a ring arrays. A circular array can be seen as a special ring array (refer to China Patent 97202038.1, "A Ring Smart Antenna Array Used For Radio Communication System"). In a cellular mobile communication system, when implementing sector coverage, a linear array is generally used, and when implementing omnidirectional coverage, a circular array is generally used. In the present invention, a circular array is used as an example.

Suppose it is a circular array, then D(n)=2×(n−1)×π/N;

$$f(\phi,D(n))=exp(j\times 2\times r/\lambda\times\pi\times\cos(\Phi-D(n)))\ \text{(find exponent).}$$

Wherein r is the radius of a circular antenna array and λ is the working wavelength. FIG. 3, for example, shows a power directional diagram of an omnidirectional beam forming for a normal circle antenna array with 8 antennas. Squares of digits 1.0885, 2.177, 3.2654, shown in FIG. 3, represent power.

Using a minimum mean-square error algorithm, the mean square error ϵ in formula (3) is the minimum one:

$$\varepsilon=\frac{1}{K}\sum_{i=1}^{K}|P(\phi_i)^{1/2}-A(\phi_i)|^2\times C(i) \tag{3}$$

In formula (3), K is the number of sampling points, when using an approximation algorithm; and C(i) is a weight. For some points, if the required approximation is high, then C(i) is set larger, otherwise C(i) is set smaller. When required approximations for all points are coincident, C(i) will be set as 1, in general.

Further, considering that transmission power of every antenna unit is limited, when taking the amplitude of W(n) to represent the transmission power of an antenna unit, and setting the maximum transmission power of each antenna unit as T(n), the limited condition can be expressed as:

$$|W(n)|\leqq T(n)^{1/2} \tag{condition 1}$$

Obviously, to find out an optimal value of the transmission power within the limit for every antenna unit, in general it only can be solved by selection and exhaustion of unsolved W(n) accuracy, except for some special situations which can be directly solved by a formula. Nevertheless, when using such an exhaustive solution, the calculation volume is very large and has an exponential relationship with the number of antenna units N. Although, the calculation volume can be decreased by gradually raising the accuracy and decreasing the scope of the value to be solved, but even only to solve for this sub-optimal value, the calculation volume is still too large.

SUMMARY OF THE INVENTION

In order to effectively improve smart antenna array coverage, a method to improve smart antenna array coverage has been designed. The improvement includes having the real coverage of an antenna array approach the design coverage; and when part of an antenna unit is shut down because of trouble, the antenna radiation parameter of other normal working antenna units can be immediately adjusted to rapidly recover the cell coverage.

The purpose of the invention is to provide a method, which can adjust parameters of antenna units of an antenna array according to a practical need. With this method, an antenna array has a specific beam forming satisfying requirement, and the emission power optimal value of each antenna unit can be rapidly solved within a limit to obtain a local optimization effect.

The method of the present invention is one kind of baseband digital signal processing methods. The method changes the size and shape of the coverage area of a smart antenna array, by adjusting parameter of each antenna (excluding those shut down antennas) of the smart antenna array, to obtain a local optimization effect coinciding with requirement under minimum mean-square error criterion. The specific adjusting scheme is that according to a difference of size and shape between coverage required in engineering design and actually realized coverage, an antenna's radiation parameters are adjusted by a method of step-by-step approximation under the minimum mean-square error criterion, in order to make the actual coverage of an antenna array approximate the engineering design requirements under locally optimized conditions.

According to the present invention, adjusting the beam forming parameter W(n) for each antenna unit n of an N antenna array, according to actual situations, further comprises:

A. setting an accuracy of W(n) to be solved, i.e. an adjusting step length;

B. setting initial values, including: an initial value $W_0(n)$ of beam forming parameter W(n) for antenna unit n; an initial value co of minimum mean-square error $\epsilon$, a counting variable for recording the minimum adjustment times; an adjustment ending threshold value M and a maximum emission power amplitude T(n) for antenna unit n;

C. entering a loop for W(n) adjustment which comprises: generating a random number; deciding a change of W(n) by the set step length and calculating a new W(n); when deciding the absolute value of W(n) being less than or equal to $T(n)^{1/2}$, calculating the minimum mean-square error $\epsilon$; when $\epsilon$ is greater than or equal to $\epsilon_0$; keeping the $\epsilon$ and increment the counting variable by 1;

D. repeating the step C until the counting variable is greater than or equal to the threshold value M, ending the adjusting procedure and getting the result; recording and storing the final W(n), and replacing the $\epsilon_0$ with the new $\epsilon$.

When comparing $\epsilon$ and $\epsilon_0$ in the step C, if is less than $_{\epsilon 0}$, then the calculation result W(n) of this time adjustment is recorded and stored, the $\epsilon_0$ is replaced with the new calculated $\epsilon$ and the counting variable is reset to zero.

The adjusting step length can be fixed or varied. If the adjusting step length is varied, then setting a minimum adjusting step length is also included during the setting of initial values. When the counting variable is greater than or equal to the threshold value M, but the adjusting step length is not equal to the minimum adjusting step length, the adjusting step length is continually decreased and the adjusting procedure of W(n) is continued.

The adjusting procedure ending conditions further include a preset adjustment ending threshold value $\epsilon'$, and when $\epsilon<\epsilon'$, the adjustment is ended.

The number of the initial value $W_0(n)$ is related to the number of antenna units, which comprise the smart antenna array.

When setting the initial value $W_0(n)$ of W(n), $W_0(n)$ is set to zero for antenna units of the smart antenna array that are shut down and W(n) for the shut down antenna units will not be adjusted in the successive adjusting loop.

The minimum mean-square error $\epsilon$ is calculated by the following formula:

$$\varepsilon = \frac{1}{K}\sum_{i=1}^{K}|P(\phi_i)^{1/2} - A(\phi_i)|^2 \times C(i),$$

Wherein $P(\phi_i)$ is an antenna unit's emission power when the beam forming parameter of the antenna unit is W(n) and the directional angle is $\phi$, and $P(\phi_i)$ is related to the antenna array type; $A(\phi_i)$ is the $\phi$ directional radiation strength with equal distance and the expected observation point having phase $\phi$ for polar coordinates; K is the number of sample points when using the approximate method and C(i) is a weight.

The setting of an accuracy of W(n) to be solved, i.e. an adjusting step length, comprises:

Setting the stepping change of the real part and an imaginary part for a complex number W(n), respectively; or setting the stepping change of an amplitude and a phase for a polar coordinates W(n), respectively;

when using the stepping change of a real part and an imaginary part for a complex number W(n), the new W(n) is calculated by the formula: $W^{U+1}(n)=W^U(n)+\Delta W^U(n)=I^U(n)+(-1)^{L_1U}\Delta I^U(n)+j*[Q^U(n)+(-1)^{L_0U}\Delta Q^U(n)]$, wherein $\Delta I^U(n)$ and $\Delta Q^U(n)$ are the adjusting step length of the real part $I^U(n)$ and imaginary part $Q^U(n)$, respectively; $L_1^U$ and $L_Q^U$ decide adjusting direction of the real part $I^U(n)$ and imaginary part $Q^U(n)$, respectively; their values are decided by a generated random number;

when using the stepping change of an amplitude and a phase for a polar coordinates W(n), the new W(n) is calculated by the formula: $W^{U+1}(n)=W^U(n)*\Delta W^U(n)=A^U(n)*\Delta A^U(n)^{(-1)L_AU}*e^{j*[\phi^U(n)+(-1)^{L^U}\phi\Delta\phi^U(n)]}$, wherein $\Delta A^U(n)$ and $\Delta\phi^U(n)$ are the adjusting step length of the amplitude $A^U(n)$ and phase $\phi^U(n)$, respectively; $L_A^U$ and $L_\phi^U$ decide adjusting direction of the amplitude $A^U(n)$ and phase $\phi^U(n)$, respectively, their value are decided by a generated random number;

the U is the $U^{th}$ adjustment and U+1 is the next adjustment.

The method of the invention concerns the case that when a radio base station uses a smart antenna array for fixed beam forming of omnidirectional coverage, the smart antenna array coverage can be effectively improved. The coverage size and shape of a smart antenna array is changed by adjusting the parameters of each antenna unit of the antenna array in order to obtain a local optimal effect of coincident requirement under the minimum mean-square error criterion.

The method of the invention is that according to a difference of size and shape between coverage required in engineering design and actually realized coverage, an antenna's radiation parameters are adjusted by a method of step-by-step approximation under the minimum mean-square error criterion, in order to make the actual coverage of an antenna array approximate the engineering design requirement under local optimization conditions.

One application of the method is at the installation site of a smart antenna array; where the coverage size and shape of a smart antenna array can be changed by adjusting the parameters of each antenna unit of the smart antenna array to obtain an omnidirectional radiation beam forming which closely approximates an expected beam forming shape and has a local optimization results for coinciding with engineering design requirements. Another application of the method is that when one or more of the antenna units in a smart antenna array are not normal and have been shut down, antenna radiation parameters of the remaining normal antenna units can be immediately adjusted by the method to immediately recover omnidirectional coverage for the cell.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
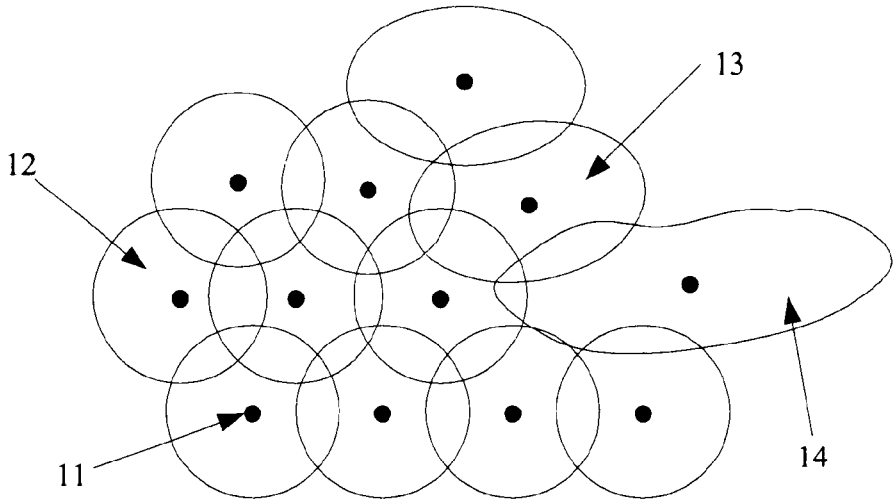
FIG. 1 is an exemplary cell distribution diagram for a cellular mobile communication network.
Figure 2:
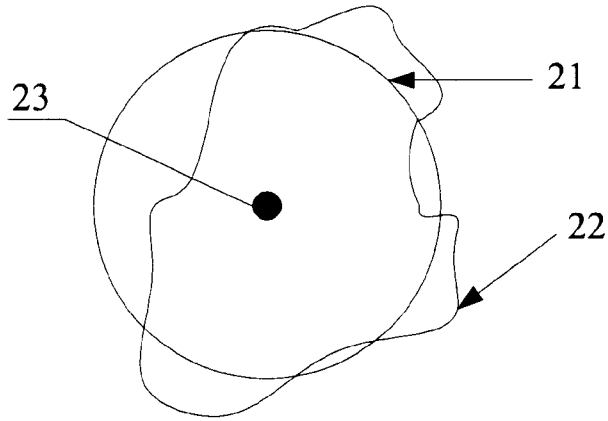
FIG. 2 is an exemplary diagram of the difference between needed cell coverage and real cell coverage.
Figure 3:
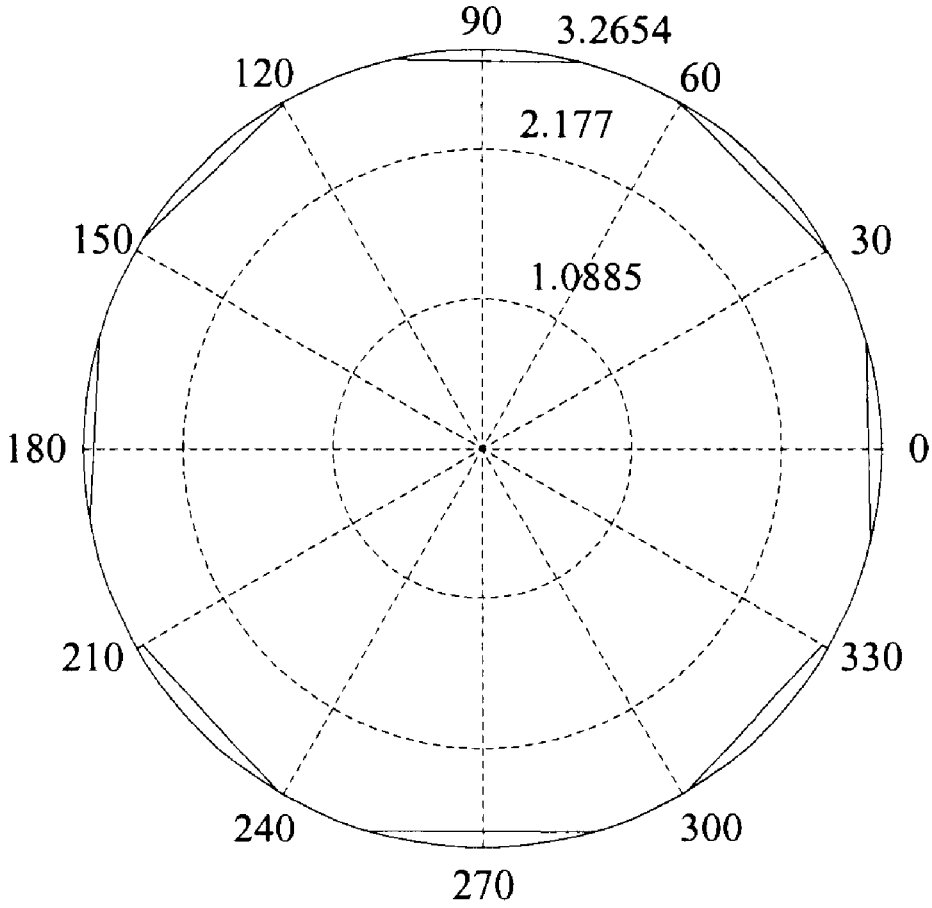
FIG. 3 is an exemplary omnidirectional beam forming power direction diagram of an eight-antenna array with normal circle coverage.

FIG. 1 to FIG. 3 have been described before, and will not be repeated.

Figure 4:
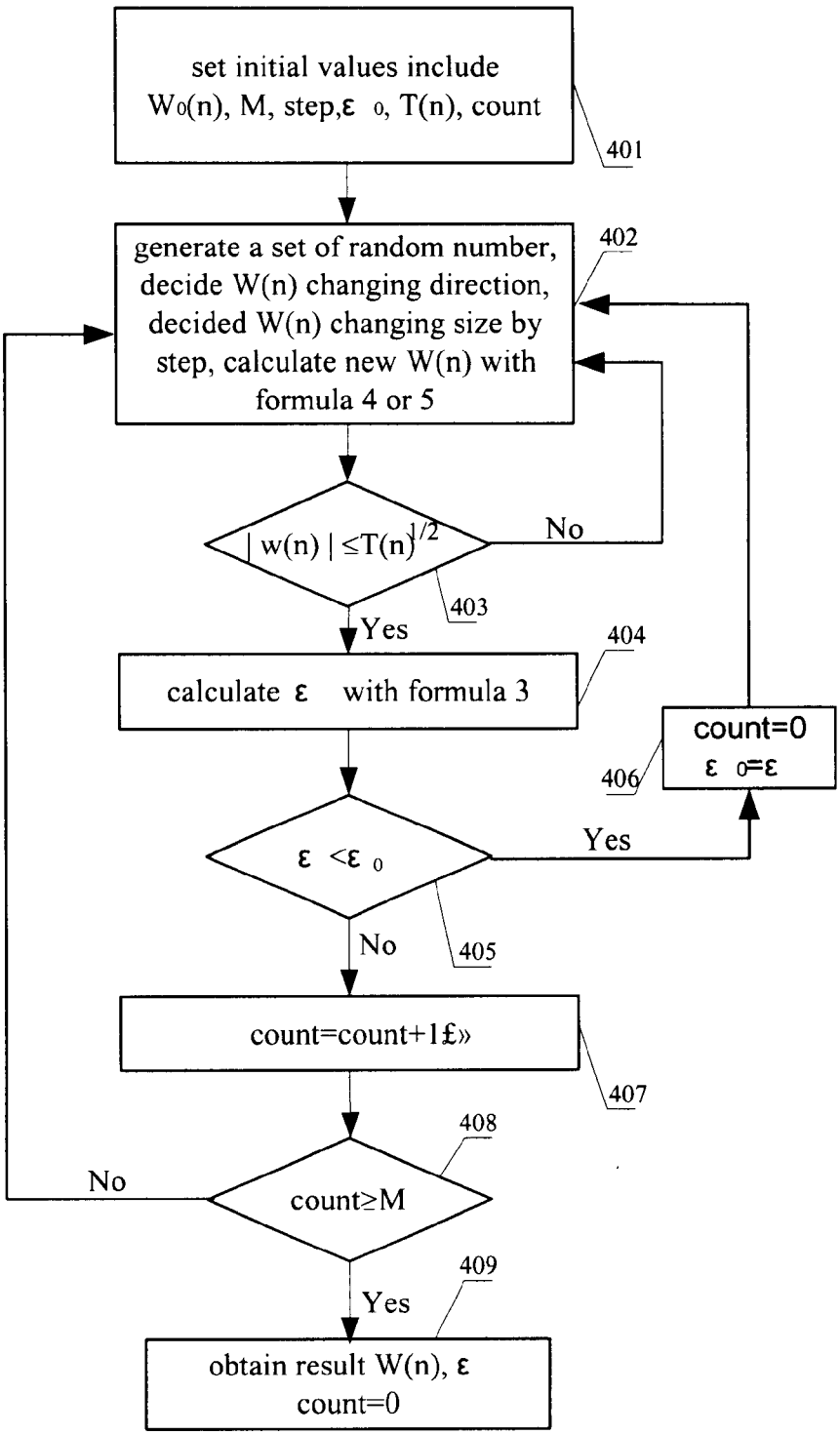
FIG. 4 is a flowchart of a method of rapidly improving an antenna array beam forming coverage with a fixed step length in an embodiment of the invention.
Figure 5:
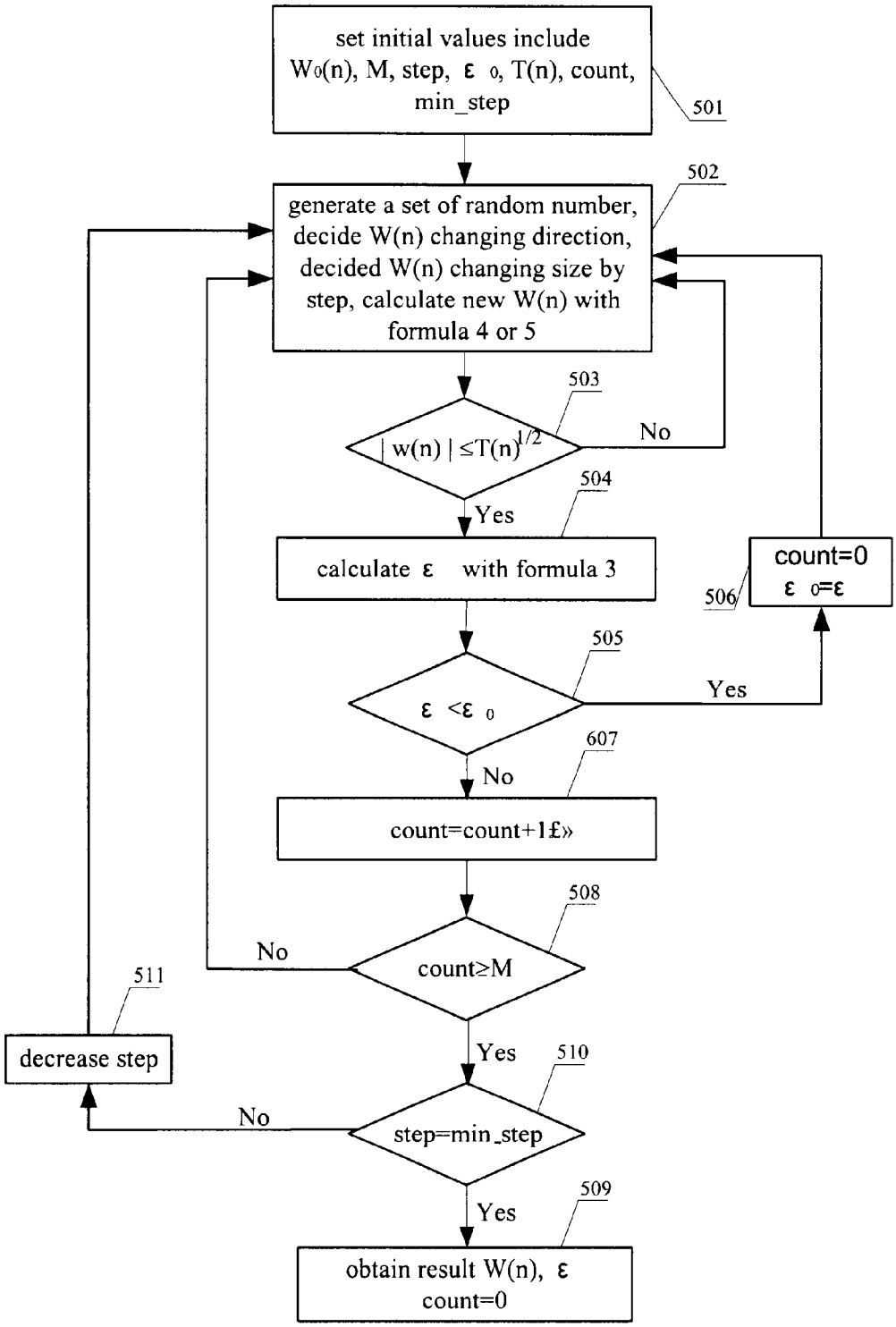
FIG. 5 is a flowchart of a method of rapidly improving an antenna array beam forming coverage with an alterable step length in an embodiment of the invention.
Figure 6:
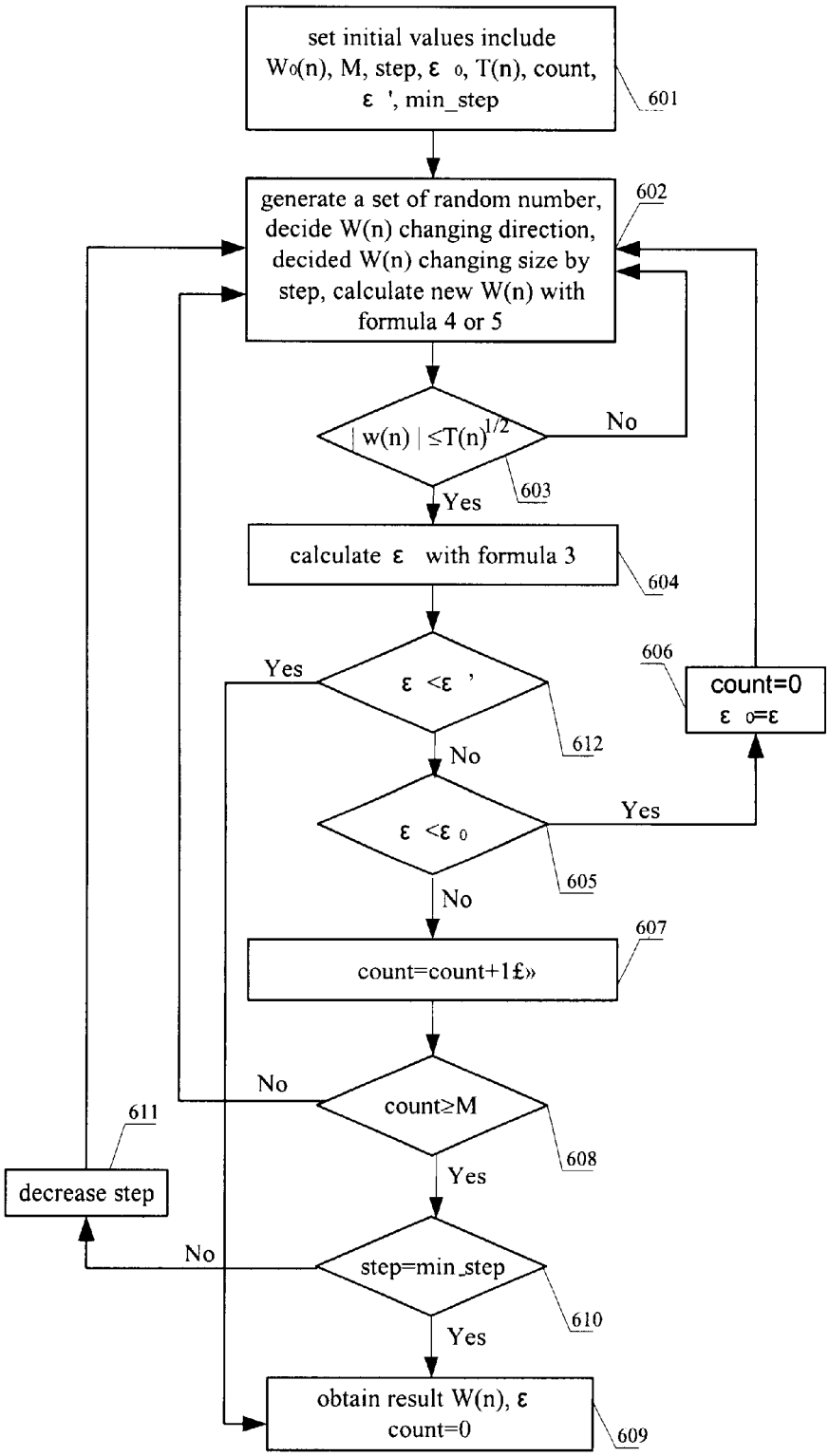
FIG. 6 is a flowchart of a method for having an ending condition for rapidly improving an antenna array beam forming coverage with an alterable step length in an embodiment of the invention.

Referring to FIG. 4, FIG. 5 and FIG. 6, the invention is a method, which rapidly solves, within a limited scope, an optimization value of the beam forming parameter W(n) for any antenna unit n in an antenna array to obtain local optimization effect. The method roughly includes the following five steps:

Step 1

Set the accuracy of W(n) to be solved, i.e. adjusting step length of W(n) during the whole solving procedure. There are two kinds of adjusting step length setting methods: one is to set, respectively, real part and imaginary part of a W(n) in complex number and changes in step; another is to set, respectively, amplitude and angle of a W(n) in polar coordinates and changes in step.

Assuming that after the $U^{th}$ adjustment, the W(n) is $W^U(n)$. Then, when using the first adjustment method, $W^U(n)$ is expressed as a complex number: $W^U(n)=I^U(n)+j\times Q^U(n)$. After the next adjustment, the $W^{U+1}$ (n) can be expressed as (formula 4):

$$W^{U+1}(n)=W^U(n)+\Delta W^U(n)=I^U(n)+(-1)^{L_1^U}\Delta I^U(n)+j*[Q^U(n)+(-1)^{L_Q^U}\Delta Q^U(n)] \quad (4)$$

Wherein $\Delta I^U(n)$ and $\Delta Q^U(n)$ are adjusting step lengths of the real part $I^U(n)$ and imaginary part $Q^U(n)$, respectively; $L_1^U$ and $L_Q^U$ decide the adjusting direction of the real part $I^U(n)$ and imaginary part $Q^U(n)$, respectively; their values will be decided by a random decision method in step 2.

When using the second adjustment method, $W^U(n)$ is expressed by a polar coordinate: $W^U(n)=A^U(n)e^{j\phi^U(n)}$. After next adjustment, the $W^{U+1}(n)$ can be expressed as (formula 5):

$$W^{U+1}(n)=W^U(n)*\Delta W^U(n)=A^U(n)*\Delta A^U(n)^{(-1)^{L_A^U}}*e^{j*[\phi^U(n)+(-1)^{L_\phi^U}\Delta\phi^U(n)]} \quad (5)$$

Wherein $\Delta A^U(n)$ and $\Delta\phi^U(n)$ are adjusting step lengths of the amplitude $A^U(n)$ and phase $\phi^U(n)$, respectively; $L_A^U$ and $L_\phi^U$ decide adjusting direction of the amplitude $A^U(n)$ and phase $\phi^U(n)$, respectively, their value will be decided by a random decision method in step 3.

Step 2

Set a set of W(n) initial value $W_0(n)$, which satisfies limit condition 1: $|W(n)|\leqq T(n)^{1/2}$, the number of $W_0(n)$ relates to antenna units number N of the antenna array. For those shut down antenna units, their $W_0(n)$ should be zero and they will not be adjusted in the successive steps. Selection of the initial value $W_0(n)$ has a certain degree of influence for the convergent speed of the algorithm and the final result. If a rough scope of W(n) has been known before, then it is better to select a set of $W_0(n)$ corresponding to the scope, and this is also a benefit for raising the result accuracy.

Then, set an initial value go of the minimum mean-square error $\epsilon$. In order to enter the loop adjustment stage faster, in general, the initial value $\epsilon_0$ is set with a larger value and the counting variable (count) is set to 0. The "count" is used to record the minimum adjustment times needed for W(n) under a go corresponding to a set of $W_0(n)$. M is a required threshold used to decide when the adjustment would be ended and the result can be output. Obviously, with a larger M value, the result is more reliable.

The initial value setting procedures, mentioned above, are shown in blocks 401, 501 and 601 of FIGS. 4, 5 and 6, respectively. These include the following setting: $W_0(n)$, M, adjusting step length ("step"), initial value of minimum mean-square error $\epsilon_0$, maximum transmission power of $n^{th}$ antenna T(n) and counting variable (count). The difference between blocks 501, 601 and block 401 are that blocks 501 and 601 further include setting a minimum adjusting step length (min_step), which is needed for using an alterable step length adjustment.

Step 3

With the procedure in step 1 and formulas (4) or (5), a new W(n) is created, i.e. adjusting W(n). Each time, a set of random numbers is generated, then according to the random number, changing the direction of W(n) is decided. If after adjustment, W(n) breaks the limit of condition 1, ($|W(n)| \leqq T(n)^{1/2}$), then the W(n) is added or subtracted, the amount of add or subtract decided by the adjusting step length ("step"). At this moment the correct changing trend is not known, so the same additions to the probability and subtractions from the probability are taken. Operation of step 3 is shown at blocks 402 and 403, 502 and 503, or 602 and 603 in FIGS. 4, 5 or 6, respectively.

Step 4

After adjustment, if W(n) satisfies the condition 1 limitation, then a new minimum mean-square error $\epsilon$ is calculated with formula 3. If $\epsilon<\epsilon_0$, then W(n) of this time is recorded and stored, $\epsilon_0$ is replaced by a new $\epsilon$, and counting variable is set to zero (count=0). The operation of this step is shown at blocks 404, 405 and 406 of FIG. 4, blocks 504, 505 and 506 of FIG. 5, or blocks 604, 605 and 606 of FIG. 6. In FIG. 6, $\epsilon<\epsilon'$ is an ending condition of the adjustment, so before making the decision $\epsilon<\epsilon_0$, the decision $\epsilon<\epsilon'$ must be made first; when $\epsilon$ is greater than $\epsilon'$, then the decision $\epsilon<\epsilon_0$ will be made, as shown in block 612 of FIG. 6. If $\epsilon \geqq \epsilon_0$ then the $\epsilon$ is kept and the counting variable is incremented (count+1), the operation is shown at blocks 407, 507 or 607 in FIGS. 4, 5 or 6, respectively. After decision $\epsilon \geqq \epsilon_0$, has been made and blocks 407, 507 or 607 have been executed, each time the counting variable "count" should be checked to determine whether it is greater than the preset threshold value M, this operation is shown at block 408, 508 or 608 in FIGS. 4, 5 or 6, respectively.

Step 5

When it has been decided that $\epsilon \geqq \epsilon_0$ and "count" is less than the preset threshold value M, it is returned to step 3, i.e. blocks 402, 502 or 602 in FIGS. 4, 5 or 6, respectively, are executed again. Consequently, a set of random number is regenerated; and W(n+1) is calculated, if a set of W(n) has been calculated, then restart from W(1). Repeat the procedure above until "count"$\geqq$M has been detected at blocks 408, 508 or 608 in FIGS. 4, 5, or 6, respectively. Then, the whole adjusting procedure is ended. At this moment, the recorded W(n) is a set of optimal solutions, so is the corresponding minimum mean-square error, and the counting variable is set to zero (count=0). The operation is shown at blocks 409, 509 or 609 in FIGS. 4, 5, or 6, respectively.

The solution obtained from the steps above is only a local optimization solution, but the calculation volume is much less and a set of solutions can be quickly obtained. If not satisfied with the solution of this time, then the procedure can be repeated, several sets of solution can be obtained and a set of solution with minimum mean-square error $\epsilon$ can be chosen. Of course, when the procedure is repeated, the initial value $W_0(n)$ of W(n) must be updated.

If the result is still unsatisfied, then alterable step length and raising accuracy can be used to improve the algorithm mentioned above, as shown in FIGS. 5 and 6. In blocks 501 or 601, during setting initial values, a minimum adjusting step length (min_step) is set. At the beginning of the adjustment, a larger step length is used for adjustment. At blocks 510 or 610, when "count" is greater than M but "step" is greater than min_step, the calculation procedure is not ended instead blocks 511 or 611 are executed. The adjusting step length is decreased at blocks 511 or 611, with the decreased step length the W(n) is changed and the minimum mean-square error $\epsilon$ is calculated again and so on. Only when "count" is greater than M and "step" equals to min_step (step=min_step); then the calculation is ended, the result is output and a set of W(n) and the corresponding mean-square error $\epsilon$ are obtained. Under the same accuracy condition, varied length, in FIG. 5 or 6, can raise calculation speed in a certain degree.

FIG. 6 shows a procedure where a system has a definite requirement of the mean-square error $\epsilon$. This is expressed as $\epsilon<\epsilon'$, wherein $\epsilon'$ is a preset threshold value. In this case, the procedure ending condition must be changed accordingly, that is a block 612 is added before block 605, and when $\epsilon<\epsilon'$, the procedure is ended. In another embodiment, $\epsilon<\epsilon'$ can be deployed as ending condition, but using a fixed step length algorithm (as shown in FIG. 4) to quickly improve antenna array beam forming coverage.

Figure 7:
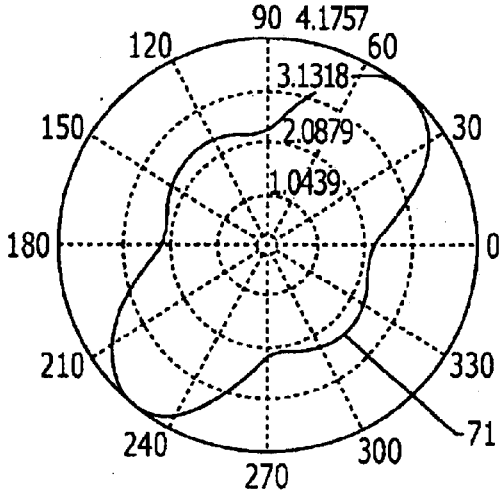
FIG. 7 and FIG. 8 are exemplary power direction diagrams before adjustment and after adjustment, respectively, for an eight-antenna array with normal circle coverage omnidirectional beam forming when there is one antenna unit without working normally for an embodiment of the invention.
Figure 8:
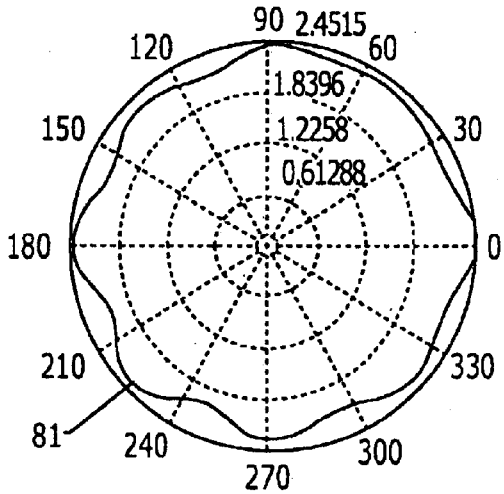

FIGS. 7 and 8 describe the effect of an application of an embodiment of the invention by the comparison of two diagrams. For example, by taking a circular antenna array with eight units, as shown in FIG. 3 (the invention is appropriate to any type of an antenna array and can dynamically make beam forming in real time, here only taking a circular antenna array as an illustrative example). When an antenna unit (including the antenna, feeder cable and connected radio frequency transceiver, etc.) of the antenna array has trouble, the radio base station must shut down the antenna unit with trouble and the radiation diagram of the antenna array is greatly affected. FIG. 7 shows that when one antenna unit does not work, the radiation diagram of the antenna array is changed from an ideal circle to an irregular graph 71, and the cell coverage is immediately affected. With the method of the invention, the radio base station obtains the parameters of other normal antenna units and adjusts them immediately by changing feed amplitude and phase of all normal antenna units, so a coverage shown by graph 81 in FIG. 8 is obtained which has an approximate circle coverage.

Figure 9:
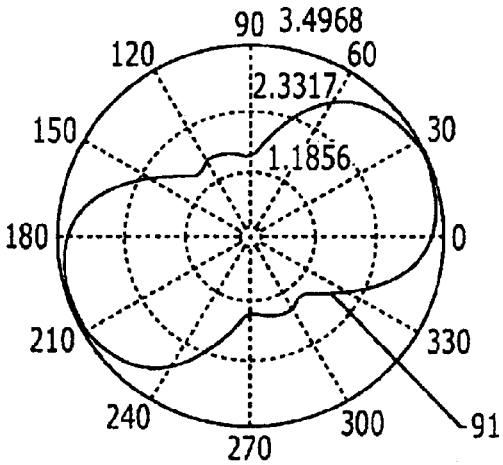
FIG. 9 and FIG. 10 are exemplary power direction diagrams before adjustment and after adjustment, respectively, for an eight-antenna array with circular coverage omnidirectional beam forming when there are two antenna units without working normally for an embodiment of the invention.
Figure 10:
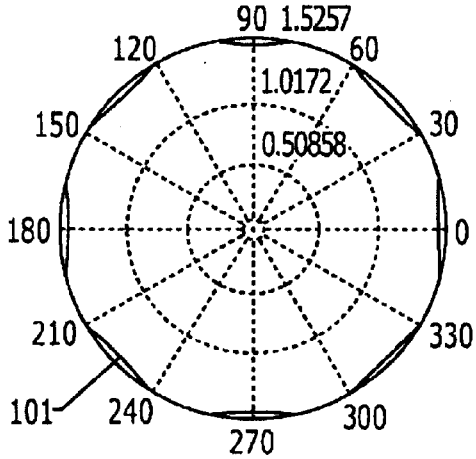

FIGS. 9 and 10 illustratively describe another effect of the application of an embodiment of the invention by the comparison of two diagrams, also by taking a circular antenna array with eight units as an example, as shown in FIG. 3 (the invention is appropriate to any type of an antenna array and can dynamically make beam forming in real time, here only taking circular antenna array as an example). When two antenna units, separated by $\pi/4$ as shown in FIG. 3, do not work, the radiation diagram of the antenna array is changed from an ideal circle to an irregular graph 91, and the cell coverage is much worse. When this happens, with the method of an embodiment of the present invention, the radio base station adjusts the parameters of other normal antenna units immediately by changing feed amplitude and phase of all normal antenna units, so a cell coverage shown by graph 101 in FIG. 10 is obtained which is obviously more approximate to a circle coverage.

It should be noted that when one or more parts of an antenna unit stop working, without increasing maximum emission power of normal antenna units, radius of the whole coverage is definitely decreased, as shown in FIG. 7 and FIG. 9. Consequently, cells coverage overlap decreases (refer to FIG. 1), so it is possible that communication blindness area appears, as shown by the examples in FIG. 7 and FIG. 9. Under equal distance, when emission power level is decreased 3~5 dB, the coverage radius will be decreased 10%~20%. Therefore, in order to solve this problem, it is necessary to increase emission power for part of antenna units, or use the "breath" function of neighbor cells.

The method for improving antenna array coverage is a procedure for adjusting the parameters of an antenna array. The beam forming parameter W(n) can be quickly obtained and a local optimization effect will be achieved.

What is claimed is:

1. A method for improving coverage of a smart antenna array, comprising:

deciding a difference of size and shape between coverage of a smart antenna array designed by mobile communication network engineering design parameters and actually realized coverage; and adjusting radiation parameters of one or more antenna units that comprise the smart antenna array by a step-by-step approximation method with minimum mean-square error arithmetic, to make the actually realized coverage approximate to the coverage of the smart antenna array designed by mobile network communication engineering, under a local optimization condition.

2. The method according to claim 1, wherein the smart antenna array is comprised of n antenna units, the radiation parameter is a beam forming parameter W(n), and the adjusting procedure comprises:

A. setting an accuracy of W(n) to be solved, i.e. an adjusting step length;

B. setting initial values including: an initial value $W_0(n)$ of the beam forming parameter W(n) for antenna unit n; an initial value co of minimum mean-square error $\epsilon$; a counting variable for recording the minimum adjustment times; an adjustment ending threshold value M and a maximum emission power amplitude T(n) for antenna unit n;

C. entering a loop for W(n) adjustment which comprises: generating a random number; deciding a change of W(n) by the set step length and calculating a new W(n); if the absolute value of W(n) is less than or equal to $T(n)^{1/2}$, then calculating the minimum mean-square error $\epsilon$; when is greater than or equal to $\epsilon_0$, keeping the $\epsilon$ and incrementing the counting variable by 1; and D. repeating the step c until the counting variable is greater than or equal to the threshold value M, then ending the adjusting procedure and getting the result; recording and storing the final W(n), and replacing the co with the new $\epsilon$.

3. The method according to claim 2, wherein the step C further comprises recording and storing the calculation result W(n) of this adjustment, replacing the $\epsilon_0$ with the new $\epsilon$ and resetting the counting variable to zero while $\epsilon$ is less than $\epsilon_0$.

4. The method according to claim 2, wherein the adjusting step length is fixed.

5. The method according to claim 2, wherein the adjusting step length is varied and setting the initial values further includes a minimum adjusting step length; and when the counting variable is greater than or equal to the threshold value M, the step D further comprises:

deciding whether the adjusting step length is equal to the minimum adjusting step length, if not, then decreasing the adjusting step length and going to step C.

6. The method according to claim 2, wherein setting the initial values further includes an adjustment ending threshold value $\epsilon'$; and when the counting variable is greater than or equal to the threshold M, the step D further comprises:

deciding whether $\epsilon$ is less than $\epsilon'$, if not, then going to step C.

7. The method according to claim 2, wherein the number of the initial value $W_0(n)$ is related to the number of antenna units that comprise the smart antenna array.

8. The method according to claim 2, wherein when setting the initial value $W_0(n)$ of W(n), $W_0(n)$ is set to zero for shut down antenna units of the smart antenna array and W(n) for the shut down antenna units will not be adjusted in the successive adjusting loop.

9. The method according to claim 2, wherein the minimum mean-square error $\epsilon$ is calculated by the formula:

$$\varepsilon = \frac{1}{K}\sum_{i=1}^{K}|P(\phi_i)^{1/2} - A(\phi_i)|^2 \times C(i),$$

wherein $P(\phi_i)$ is an antenna unit's emission power when a beam forming parameter of the antenna unit is W(n) and the directional angle is $\phi$, and $P(\phi_i)$ is related to the antenna array type; $A(\phi_i)$ is the $\phi$ directional radiation strength with equal distance and the expected observation point having phase $\phi$ for polar coordinates; K is the number of sample points when using an approximate method and C(i) is a weight.

10. The method according to claim 2, wherein setting an accuracy of W(n) to be solved, i.e. an adjusting step length, comprises:

setting a stepping change of a real part and an imaginary part for a complex number W(n), respectively; or setting a stepping change of an amplitude and a phase for a polar coordinates W(n), respectively;

when using the stepping change of a real part and an imaginary part for a complex number W(n), the new W(n) is calculated by the formula: $W^{U+1}(n)=W^U(n)+\Delta W^U(n)=I^U(n)+(-1)^{L^U}\Delta I^U(n)+j*[Q^U(n)+(-1)^{L_Q U}\Delta Q^U(n)]$, wherein $\Delta I^U(n)$ and $\Delta Q^U(n)$ are the adjusting step length of the real part $I^U(n)$ and imaginary part $Q^U(n)$, respectively; $L_1^U$ and $L_Q^U$ decide adjusting direction of the real part $I^U(n)$ and imaginary part $Q^U(n)$, respectively; their values are decided by a generated random number;

when using the stepping change of an amplitude and a phase for a polar coordinates W(n), the new W(n) is calculated by the formula: $W^{U+1}(n)=W^U(n)*\Delta W^U(n)=A^U(n)*\Delta A^U(n)^{(-1)^{L_A U}}*e^{j*[\phi^U(n)+(-1)^{L^U}\phi\Delta\phi^U(n)]}$, wherein $\Delta A^U(n)$ and $\Delta\phi^U(n)$ are the adjusting step length of the amplitude $A^U(n)$ and phase $\phi^U(n)$, respectively; $L_A^A$ and $L_\phi^U$, decide adjusting direction of the amplitude $A^U(n)$ and phase $\phi^U(n)$, respectively, their value are decided by a generated random number;

the U is the $U^{th}$ adjustment and U+1 is the next adjustment.

11. A method for improving coverage of a smart antenna array, comprising:

A. setting initial values including: an initial value $W_0(n)$ of beam forming parameter W(n) for antenna unit n, comprising at least part of the smart antenna array; an adjustment ending threshold value M; an accuracy of W(n), i.e. an adjusting step length ("step"); an initial value $\epsilon_0$ of minimum mean-square error $\epsilon$, a maximum value of emission power amplitude T(n) and a counting variable ("count") for recording the minimum adjustment times;

B. generating a set of random numbers, deciding W(n) changing direction, deciding W(n) changing size by the "step", generating W(n) of the $U^{th}$ adjustment by the formula: $W^{U+1}(n)=W^{U}(n)+\Delta W^{U}(n)$;

C. comparing the W(n) and T(n): when the absolute value of W(n) is greater than $T(n)^{1/2}$, continuing the W(n) generating operation; when the absolute value of W(n) is less than or equal to $T(n)^{1/2}$, calculating the minimum mean-square error $\epsilon$;

D. comparing $\epsilon$ and $\epsilon_0$: when $\epsilon$ is less than $\epsilon_0$, setting $\epsilon_0$ to be equal to $\epsilon$ and resetting "count" to be equal to zero, then continuing the W(n) generating operation; when $\epsilon$ is not less than $\epsilon_0$, keeping the $\epsilon$ and increasing "count" by 1; and E. comparing "count" and M: when "count" is less than M, continuing the W(n) generating operation; when "count" is greater than or equal to M, ending the adjustment, getting the result W(n), $\epsilon$ and resetting "count" to zero.

12. The method according to claim 11, wherein the minimum mean-square error $\epsilon$ is calculated by the formula:

$$\varepsilon = \frac{1}{K}\sum_{i=1}^{K}|P(\phi_i)^{1/2} - A(\phi_i)|^2 \times C(i),$$

wherein $P(\phi_i)$ is an antenna unit's emission power when a beam forming parameter of the antenna unit is W(n) and the directional angle is $\phi$, and $P(\phi_i)$ is related to the antenna array type; $A(\phi_i)$ is the $\phi$ directional radiation strength with equal distance and the expected observation point having phase $\phi$ for polar coordinates; K is the number of sample points when using an approximate method and C(i) is a weight.

13. The method according to claim 11, wherein setting accuracy of W(n) to be solved, i.e. an adjusting step length, comprises:

setting a stepping change of a real part and an imaginary part for a complex number W(n), respectively; or setting a stepping change of an amplitude and a phase for a polar coordinates W(n), respectively;

when using the stepping change of a real part and an imaginary part for a complex number W(n), the new W(n) is calculated by the formula: $W^{U+1}(n)=W^{U}(n)+\Delta W^{U}(n)=I^{U}(n)+(-1)^{L_1^U}\lambda I^{U}(n)+j*\lfloor Q^{U}(n)+(-1)^{L_Q^U}\Delta Q^{U}(n)\rfloor$, wherein $\Delta I^{U}(n)$ and $\lambda Q^{U}(n)$ are the adjusting step length of the real part $I^{U}(n)$ and imaginary part $Q^{U}(n)$, respectively; $L_1^U$ and $L_Q^U$ decide adjusting direction of the real part $I^{U}(n)$ and imaginary part $Q^{U}(n)$, respectively; their values are decided by a generated random number;

when using the stepping change of an amplitude and a phase for a polar coordinates W(n), the new W(n) is calculated by the formula: $W^{U+1}(n)=W^{U}(n)*\Delta W^{U}(n)=A^{U}(n)*\Delta A^{U}(n)^{(-1)^{L_A^U}}*e^{j*[\phi^{U}(n)+(-1)^{L_\phi^U}\Delta\phi^{U}(n)]}$, wherein $\Delta A^{U}(n)$ and $\Delta\phi^{U}(n)$ are the adjusting step length of the amplitude $A^{U}(n)$ and phase $\phi^{U}(n)$, respectively; $L_A^U$ and $L_\phi^U$ decide adjusting direction of the amplitude $A^{U}(n)$ and phase $\phi^{U}(n)$, respectively, their value are decided by a generated random number; and the U is the $U^{th}$ adjustment and U+1 is the next adjustment.

14. A method for improving coverage of a smart antenna array, comprising:

A. setting initial values including: an initial value $W_0(n)$ of beam forming parameter W(n) for antenna unit n, comprising at least part of the smart antenna array; an adjustment ending threshold value M; an accuracy of W(n), i.e. an adjusting step length ("step"); an initial value $\epsilon_0$ of minimum mean-square error $\epsilon$, a maximum value of emission power amplitude T(n), a counting variable ("count") for recording the minimum adjustment times and a minimum adjusting step length ("min_step");

B. generating a set of random numbers, deciding W(n) changing direction, deciding W(n) changing size by the "step", generating W(n) of the $U^{th}$ adjustment by the formula: $W^{U+1}(n)=W^{U}(n)+\Delta W^{U}(n)$;

C. comparing the W(n) and T(n): when the absolute value of W(n) is greater than $T(n)^{1/2}$, continuing the W(n) generating operation; when the absolute value of W(n) is less than or equal to $T(n)^{1/2}$, calculating the minimum mean-square error $\epsilon$, D. comparing $\epsilon$ and $\epsilon_0$: when $\epsilon$ is less than $\epsilon_0$, setting $\epsilon_0$ to be equal to $\epsilon$ and resetting "count" to be equal to zero, then continuing the W(n) generating operation; when $\epsilon$ is not less than $\epsilon_0$, keeping the $\epsilon$ and increasing "count" by 1;

E. comparing "count" and M: when "count" is less than M, continuing the W(n) generating operation; when "count" is greater than or equal to M, going to step F; and F. deciding whether "step" is equal to min_step: when "step" is not equal to min_step, decreasing the "step" and continuing the W(n) generating operation; when "step" is equal to min_step, ending the adjustment, getting the result W(n), $\epsilon$ and resetting "count" to zero.

15. The method according to claim 14, wherein the minimum mean-square error $\epsilon$ is calculated by the formula:

$$\varepsilon = \frac{1}{K}\sum_{i=1}^{K}|P(\phi_i)^{1/2} - A(\phi_i)|^2 \times C(i),$$

wherein $P(\phi_i)$ is an antenna unit's emission power when a beam forming parameter of the antenna unit is W(n) and the directional angle is $\phi$, and $P(\phi_i)$ is related to the antenna array type; $A(\phi_i)$ is the $\phi$ directional radiation strength with equal distance and the expected observation point having phase $\phi$ for polar coordinates; K is the number of sample points when using an approximate method and C(i) is a weight.

16. The method according to claim 14, wherein setting accuracy of W(n) to be solved, i.e. an adjusting step length, comprises:

setting a stepping change of a real part and an imaginary part for a complex number W(n), respectively; or setting a stepping change of an amplitude and a phase for a polar coordinates W(n), respectively;

when using the stepping change of a real part and an imaginary part for a complex number W(n), the new W(n) is calculated by the formula: $W^{U+1}(n)=W^{U}(n)+\Delta W^{U}(n)=I^{U}(n)+(-1)^{L_1^U}\Delta I^{U}(n)+j*\lfloor Q^{U}(n)+(-1)^{L_Q^U}\Delta Q^{U}(n)\rfloor$, wherein $\Delta I^{U}(n)$ and $\Delta Q^{U}(n)$ are the adjusting step length of the real part $I^{U}(n)$ and imaginary part $Q^{U}(n)$, respectively; $L_1^U$ and $L_Q^U$ decide adjusting direction of the real part $I^{U}(n)$ and imaginary part $Q^{U}(n)$, respectively; their values are decided by a generated random number;

when using the stepping change of an amplitude and a phase for a polar coordinates W(n), the new W(n) is calculated by the formula: $W^{U+11}(n)=W^{U}(n)*\Delta W^{U}(n)=A^{U}(n)*\Delta A^{U}(n)^{(-1)L_{A}U}*e^{j*[\phi^{U}(n)+(-1)L^{U}\phi\Delta\phi^{U}(n)]}$, wherein $\Delta A^{U}(n)$ and $\Delta\phi^{U}(n)$ are the adjusting step length of the amplitude $\Delta^{U}(n)$ and phase $\phi^{U}(n)$, respectively; $L_{A}^{U}$ and $L_{\phi}^{U}$ decide adjusting direction of the amplitude $A^{U}(n)$ and phase $\phi^{U}(n)$, respectively, their value are decided by a generated random number; and the U is the $U^{th}$ adjustment and U+1 is the next adjustment.

17. A method for improving coverage of a smart antenna array, comprising:

A. setting initial values including: an initial value $W_0(n)$ of beam forming parameter W(n) for an antenna unit n, comprising at least part of the smart antenna array; an adjustment ending threshold value M; an accuracy of W(n), i.e. an adjusting step length ("step"); an initial value $\epsilon_0$ of minimum mean-square error $\epsilon$, a maximum value of emission power amplitude T(n), a counting variable ("count") for recording the minimum adjustment times, an adjustment ending threshold value $\epsilon'$ of minimum mean-square error s and a minimum adjusting step length (min_step);

B. generating a set of random numbers, deciding W(n) changing direction, deciding W(n) changing size by the "step", generating W(n) of the $U^{th}$ adjustment by the formula: $W^{U+1}(n)=W^{U}(n)+\Delta W^{U}(n)$;

C. comparing the W(n) and T(n): when the absolute value of W(n) is greater than $T(n)^{1/2}$, continuing the W(n) generating operation; when the absolute value of W(n) is less than or equal to $T(n)^{1/2}$, calculating the minimum mean-square error $\epsilon$;

D. comparing the $\epsilon$ and $\epsilon'$: when $\epsilon$ is less than $\epsilon'$, ending the adjustment, getting the result W(n), $\epsilon$ and resetting "count" to zero; when $\epsilon$ is not less than $\epsilon'$, going to step E;

E. comparing the $\epsilon$ and $\epsilon_0$: when is less than $\epsilon_0$, setting $\epsilon_0$ to be equal to $\epsilon$ and resetting "count" to be equal to zero, then continuing the W(n) generating operation; when $\epsilon$ is not less than $\epsilon_0$, keeping the $\epsilon$ and increasing "count" by 1;

F. comparing "count" and M: when "count" is less than M, continuing the W(n) generating operation; when "count" is greater than or equal to M, going to step G; and G. deciding whether "step" being equal to min_step: when "step" is not equal to min_step, decreasing the "step" and continuing the W(n) generating operation; when "step" is equal to min_step, ending the adjustment, getting the result W(n), $\epsilon$ and resetting "count" to zero.

18. The method according to claim 17, wherein the minimum mean-square error $\epsilon$ is calculated by the formula:

$$\varepsilon = \frac{1}{K}\sum_{i=1}^{K}|P(\phi_i)^{1/2} - A(\phi_i)|^2 \times C(i),$$

wherein $P(\phi_i)$ is an antenna unit's emission power when a beam forming parameter of the antenna unit is W(n) and the directional angle is $\phi$, and $P(\phi_i)$ is related to the antenna array type; $A(\phi_i)$ is the $\phi$ directional radiation strength with equal distance and the expected observation point having phase $\phi$ for polar coordinates; K is the number of sample points when using an approximate method and C(i) is a weight.

19. The method according to claim 17, wherein setting accuracy of W(n) to be solved, i.e. an adjusting step length, comprises:

setting a stepping change of a real part and an imaginary part for a complex number W(n), respectively; or setting a stepping change of an amplitude and a phase for a polar coordinates W(n), respectively;

when using the stepping change of a real part and an imaginary part for a complex number W(n), the new W(n) is calculated by the formula: $W^{U+1}(n)=W^{U}(n)+\Delta W^{U}(n)=I^{U}(n)+(-1)L^{1U}\Delta I^{U}(n)+j*\lfloor Q^{U}(n)+(-1)^{L_{0}U}\Delta Q^{U}(n)\rfloor$, wherein $\Delta I^{U}(n)$ and $\Delta Q^{U}(n)$ are the adjusting step length of the real part $I^{U}(n)$ and imaginary part $Q^{U}(n)$, respectively; $L_{1}^{U}$ and $L_{Q}^{U}$ decide adjusting direction of the real part $I^{U}(n)$ and imaginary part $Q^{U}(n)$, respectively; their values are decided by a generated random number;

when using the stepping change of an amplitude and a phase for a polar coordinates W(n), the new W(n) is calculated by the formula: $W^{U+1}(n)=W^{U}(n)*\Delta W^{U}(n)=A^{U}(n)*\Delta A^{U}(n)^{(-1)L_{A}U}*e^{j*[\phi^{U}(n)+(-1)L^{U}\phi\Delta\phi^{U}(n)]}$, wherein $\Delta A^{U}(n)$ and $\Delta\phi^{U}(n)$ are the adjusting step length of the amplitude $A^{U}(n)$ and phase $\phi^{U}(n)$, respectively; $L_{A}^{U}$ and $L_{\phi}^{U}$ decide adjusting direction of the amplitude $A^{U}(n)$ and phase $\phi^{U}(n)$, respectively, their value are decided by a generated random number; and the U is the $U^{th}$ adjustment and U+1 is the next adjustment.

* * * * *

UNITED STATES PATENT AND TRADEMARK OFFICE

CERTIFICATE OF CORRECTION

PATENT NO. : 6,738,016 B2
DATED : May 18, 2004
INVENTOR(S) : Li et al.

It is certified that error appears in the above-identified patent and that said Letters Patent is hereby corrected as shown below:

Column 10,
Line 40, after "formula:" the equation should read

-- $W^{U+1}(n) = W^U(n) + \Delta W^U(n) = I^U(n) + (-1)^{L_I^U} \Delta I^U(n) + j * \left[Q^U(n) + (-1)^{L_Q^U} \Delta Q^U(n)\right],$ --

Line 53, after "respectively," the formula should read -- $L_A^U$ --

Column 11,
Lines 48 and 49, the formula should read:

-- $W^{U+1}(n) = W^U(n) + \Delta W^U(n) = I^U(n) + (-1)^{L_I^U} \Delta I^U(n) + j * \left[Q^U(n) + (-1)^{L_Q^U} \Delta Q^U(n)\right],$ --

Lines 57 and 58, the formula should read:

-- $W^{U+1}(n) = W^U(n) * \Delta W^U(n) = A^U(n) * \Delta A^U(n)^{(-1)L_A^U} * e^{j*\left[\phi^U(n) + (-1)^{L^U_\phi} \Delta\phi^U(n)\right]},$ --

Column 12,
Lines 59 and 60, after "formula:" the formula should read:

-- $W^{U+1}(n) = W^U(n) + \Delta W^U(n) = I^U(n) + (-1)^{L_I^U} \Delta I^U(n) + j * \left[Q^U(n) + (-1)^{L_Q^U} \Delta Q^U(n)\right],$ --

Column 13,
Lines 1 and 2, after "formula:" the equation should read:

-- $W^{U+1}(n) = W^U(n) * \Delta W^U(n) = A^U(n) * \Delta A^U(n)^{(-1)L_A^U} * e^{j*\left[\phi^U(n) + (-1)^{L^U_\phi} \Delta\phi^U(n)\right]},$ --

Lines 4 and 5, after "respectively;" the formulas should read -- $L_A^U$ and $L_\varphi^U$ --

UNITED STATES PATENT AND TRADEMARK OFFICE

CERTIFICATE OF CORRECTION

PATENT NO. : 6,738,016 B2
DATED : May 18, 2004
INVENTOR(S) : Li et al.

It is certified that error appears in the above-identified patent and that said Letters Patent is hereby corrected as shown below:

Column 14,
Lines 29 and 30, after "formula:" the equation should read:

-- $W^{U+1}(n) = W^U(n) + \Delta W^U(n) = I^U(n) + (-1)^{L_I^U} \Delta I^U(n) + j * \left[ Q^U(n) + (-1)^{L_Q^U} \Delta Q^U(n) \right],$ --

Line 33, after "respectively;" the formula should read -- $L_I^U$ --

Line 42, after "respectively;" the formula should read -- $L_A^U$ --

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,738,016 B2
DATED : May 18, 2004
INVENTOR(S) : Li et al.

It is certified that error appears in the above-identified patent and that said Letters Patent is hereby corrected as shown below:

Column 9,
Lines 36 and 51, "co" should read -- $\varepsilon_0$ --;
Line 45, should read -- error $\varepsilon$; when $\varepsilon$ is greater than or equal to $\varepsilon_0$ , keeping the --;
Line 47, "c" should read -- C --;

Signed and Sealed this

Twenty-eighth Day of September, 2004

JON W. DUDAS
*Director of the United States Patent and Trademark Office*